United States Patent [19]

Flanagan et al.

[11] Patent Number: 4,867,703

[45] Date of Patent: Sep. 19, 1989

[54] HIGH TEMPERATURE MOLDED DIELECTRIC BEAD FOR COAXIAL CONNECTOR

[75] Inventors: James R. Flanagan, New Britain; David J. Critelli, Naugatuck, both of Conn.

[73] Assigriee: Sealectro Corporation, Trumbull, Conn.

[21] Appl. No.: 233,152

[22] Filed: Aug. 17, 1988

[51] Int. Cl.[4] ..... H01R 13/54

[52] U.S. Cl. ..... 439/578

[58] Field of Search ..... 439/578–585

[56] References Cited

U.S. PATENT DOCUMENTS

| | | | |
|---|---|---|---|
| 2,468,775 | 5/1949 | Ovrebo | 439/578 |
| 2,966,645 | 12/1960 | Burl et al. | 439/578 |
| 3,673,546 | 6/1972 | Green et al. | 439/579 |

*Primary Examiner*—Joseph H. McGlynn

*Attorney, Agent, or Firm*—Thomas L. Peterson

[57] ABSTRACT

A dielectric support bead for a coaxial connector is provided. The support bead comprises a center support portion and a plurality of spaced apart outer support surfaces disposed concentrically about the inner support portion. The inner support portion includes a central through aperture dimensioned to be pressfit over the center conductor of a coaxial connector. The outer supports define segments of a cylinder and are dimensioned for pressfit engagement with the outer conductor of the coaxial connector. The outer support surfaces are maintained in concentric relationship to the center support portion by a plurality of support legs. Concave generally cylindrical surfaces extend continuously between adjacent support legs and are generated about axes extending parallel to and disposed symmetrically about the central axis of the bead. An annular shroud is disposed adjacent one end of the bead to prevent contaminants from entering the body of the connector.

17 Claims, 1 Drawing Sheet

HIGH TEMPERATURE MOLDED DIELECTRIC BEAD FOR COAXIAL CONNECTOR

BACKGROUND OF THE INVENTION

Coaxial cables comprise inner and outer conductors disposed in spaced concentric relationship with a nonconductive insulating material disposed uniformly therebetween. Coaxial cables typically are used to carry radio frequency or microwave frequency electrical signals.

Connectors are provided to electrically join the inner and outer conductors of a coaxial cable to other electrical components such as a circuit board, a microstrip, a coplanar wave guide or to another cable. It is important for the coaxial cable connector to make secure electrical and mechanical connections to both the inner and outer conductors of the cable and to maintain substantial coaxial symmetry across the connector. Significant variations in this symmetry can degrade the signal transmitted through the connector.

Coaxial cable connectors comprise substantially concentric inner and outer conductors for electrically and mechanically engaging the inner and outer conductors of a cable and/or the inner and outer conductive portions of another component. The cylindrical configuration of the outer conductor in the connector substantially ensures its required coaxial symmetry across the connector. However, the inner conductor has a radial dimension that is very small compared to its axial length. As a result, coaxial connectors typically are provided with support means surrounding the inner conductor, and supporting the inner conductor relative to the outer conductor. The support means for a coaxial connector typically comprises a bead formed from an electrically nonconductive material. The bead is constructed to be disposed generally concentrically between the inner and outer conductors. For example, most prior art beads are substantially annular in configuration and comprise a centrally disposed through aperture for surrounding and engaging the center conductor of the coaxial connector. Extreme precision is required in forming or machining the support bead. Any nonconcentricity or any manufacturing defects, such as burrs, nicks or the like, will invariably affect the electrical performance of the connector by causing losses to occur under certain operating conditions and/or at certain frequency ranges.

Dielectric support beads create an impedance which is proportional to the dielectric constant of the support bead. The dielectric constant, in turn, is indicative of the radio frequency at which the connector is capable of operating. In particular, higher operating frequencies generally can be obtained by a support bead having a low dielectric constant. Most subminiature coaxial connectors (SMA connectors) in the prior art have operated at or below 26 GHz.

It is desirable to provide coaxial connectors that can operate at frequency ranges higher than 26 GHz. As noted above, one factor affecting the performance of the coaxial connector at very high frequency ranges is the dielectric constant of the support bead. In particular, a dielectric support bead with a low dielectric constant helps to achieve a coaxial connector that can operate at higher frequency ranges. However, the options for improved engineering of the dielectric support bead are somewhat limited in view of the fact that the overall dimension of the dielectric support bead generally must be in accordance with established military specifications, which are intended to ensure compatibility of connectors.

One possible approach for reducing the dielectric constant of the support bead, and thereby increasing the frequency at which the associated connector can operate is to reduce the total amount of dielectric material in the support bead. This is somewhat difficult to achieve, however, in view of the overall external dimensional requirements of the support bead and in view of the importance of manufacturing a support bead that will keep contaminants out of the connector, such as gold flakes that may be delaminated from the plated contact surfaces of certain terminals.

One especially effective dielectric support bead for achieving the above described objectives is shown in U.S. Pat. No. 4,718,864 which issued to James R. Flanagan on Jan. 12, 1988 and which is assigned to the assignee of the subject invention. In particular, U.S. Pat. No. 4,718,864 shows an injection molded dielectric support bead having a central through aperture for supporting the center conductor of the connector, and further having an array of apertures extending through a first end face of the bead and disposed concentrically about the central through aperture thereof. Each aperture of the array of apertures in the bead of U.S. Pat. No. 4,718,864 extends a major portion of the distance through the support bead, and is aligned parallel to the central through aperture thereof. The support bead shown in U.S. Pat. No. 4,718,864 further comprises annular undercuts in the respective opposed axial ends. The bead shown in U.S. Pat. No. 4,718,864 provides adequate structural support between the inner and outer conductors of the coaxial connector, while further providing a substantially reduced amount of dielectric material in the bead. This reduced amount of dielectric material enables the overall dielectric constant of the bead to be reduced, and as a result, substantially higher operating frequencies are achievable with the associated connector. It has been found that connectors employing the dielectric support bead shown in U.S. Pat. No. 4,718,864 can operate successfully at 40 GHz.

Despite the many efficiencies of the bead described in U.S. Pat. No. 4,718,864, it is considered desirable to provide a bead that has even better performance characteristics over a broader range of environmental conditions. For example, certain coaxial electrical connectors, such as those used in military, aeronautical, and aerospace applications are subjected to extremely broad ranges of temperature. In particular, coaxial connectors may be employed in an environment having temperatures as low as −65° C. or temperatures as high as 165° C. In many known connectors these extreme temperature variations, and especially the high ranges of temperature can cause physical changes in the dielectric bead structure which will permanently degrade the signal carrying performance of the connector even after the connector has returned to less severe temperatures. Although the bead shown in U.S. Pat. No. 4,718,864 performs well under a broad range of conditions, it is desirable to provide a bead that exhibits less signal degradation after extreme environmental temperature cycling. It has also been found that although the particular bead construction shown in U.S. Pat. No. 4,718,864 performs extremely well, the highly precise apertures formed therein are difficult and costly to manufacture with the required high degree of precision.

Other coaxial connectors with support beads that have attempted to ensure high frequency signal transmission include: U.S. Pat. No. 3,229,234 which issued to Lattanzia; U.S. Pat. No. 3,492,605 which issued to Ziegler; U.S. Pat. No. 4,431,255 which issued to Banning; German Pat. No. 3033690; French Pat. No. 664,271 and British Pat. No. 1,490,421. These prior art references are considered to be less desirable in high frequency signal carrying environments than the connector and molded dielectric support bead therefor shown in U.S. Pat. No. 4,718,864. Furthermore, these prior art structures provide no teaching that would enable the connector and support bead to function in environments of extreme ranges of temperature variation.

In view of the above, it is an object of the subject invention to provide a dielectric support bead for a coaxial connector that can perform reliably at extremely high frequencies.

It is another object of the subject invention to provide a dielectric support bead with substantially invariable operating characteristics over a very broad range of temperatures.

It is an additional object of the subject invention to provide a dielectric support bead !or a coaxial connector that is substantially insensitive to frequent extreme changes in temperature.

A further object of the subject invention is to provide a dielectric support bead with a low dielectric constant and with an ability to keep contaminants out of the connector.

Still another object of the subject invention is to provide a coaxial connector having a dielectric support bead that enables the transmission of high frequencies signals even after subjection to extreme ranges of temperature cycling.

SUMMARY OF THE INVENTION

The subject invention is directed to a dielectric support bead for a coaxial connector, and to a coaxial connector which includes the dielectric support bead described herein. The coaxial connector may be either a plug or a socket connector, and may be either a straight or right angle connector. The coaxial connector comprises concentrically disposed inner and outer conductors, with the subject dielectric support bead disposed therebetween. The dielectric support bead preferably is unitarily molded from a plastic material, such as ULTEM® (a registered trademark of General Electric Co.).

The support bead comprises first and second opposed axial ends and a central through aperture extending therebetween. The central through aperture is dimensioned to telescopingly closely engage the center conductor of the coaxial connector. The support bead further comprises a plurality of outer support surfaces defining arcuate segments concentrically disposed around the central through aperture. More particularly, the arcuate support surfaces define segments of a cylinder concentrically disposed around the central through aperture of the bead. The outer support surfaces define an axial length substantially equal to the axial length of the central through aperture. The circumferential dimension of each outer support preferably is small compared to the circumferential spacing therebetween.

The outer support surfaces are maintained in the specified coaxial condition relative to the central through aperture by support legs extending in substantially radial directions. The support legs may taper into wider circumferential dimensions as they approach the central through aperture. Adjacent support legs preferably define concave continuous arcuate surfaces extending therebetween to avoid abrupt geometric or dimensional changes in the support bead that could affect the signal carrying ability of the connector. Thus, the external surface of the support bead may be defined by a plurality of concave arcuate sur!aces extending between adjacent outer support surfaces disposed about the circumference of the support bead. To ensure coaxial symmetry along the length of the support bead, these concave arcuate surfaces preferably define cylindrical surfaces with the respective axes of generation being parallel to the central axis of the support bead and disposed symmetrically thereabout.

The opposed axial ends of the support bead may include coaxially formed annular undercuts which define compensation steps that create impedence changes to compensate for stepped configurations of the body of the connector. The axial dimensions of the annular undercut will be determined by the particular construction of the connector in which the bead is mounted.

To prevent the entry of contaminants into the connector, the connector preferably is defined by an annular shroud defining a radius substantially equal to the radius of the outer support surfaces of the bead. Thus, the annular shroud extends continuously into the generally cylindrical segments which define the outer support surfaces. The annular shroud will further define an axial interruption in the concave arcuate surfaces extending between adjacent outer support surfaces. By virtue of this construction, the presence of the shroud will positively prevent the entry of contaminants into the body of the connector in which the dielectric support bead is employed. The annular shroud preferably is disposed to be adjacent the mating end of the connector in which the dielectric support bead is employed.

DETAILED DESCRIPTION OF THE PREFERRED EMBODIMENT

Figure 1:
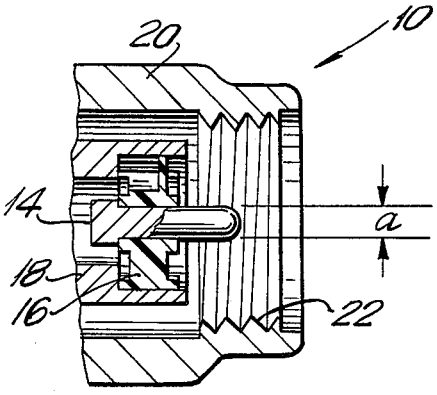
FIG. 1 is a cross-sectional view of a coaxial connector plug according to the subject invention.
Figure 2:
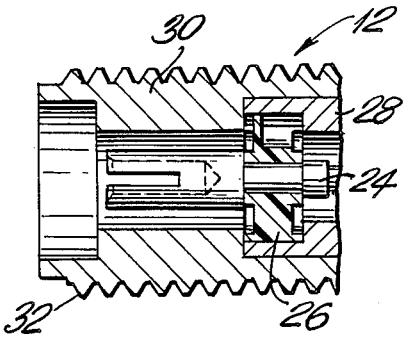
FIG. 2 is a cross-sectional view of a coaxial connector socket in accordance with the subject invention.
Figure 3:
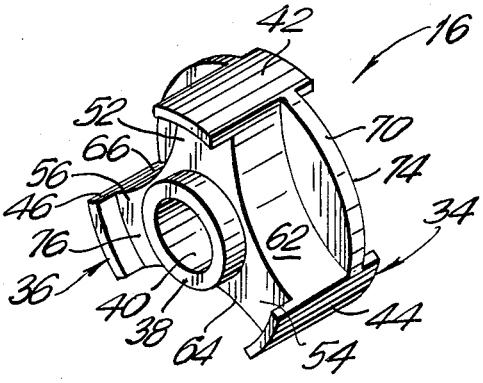
FIG. 3 is a perspective view of the molded dielectric support bead for a coaxial connector.
Figure 4:
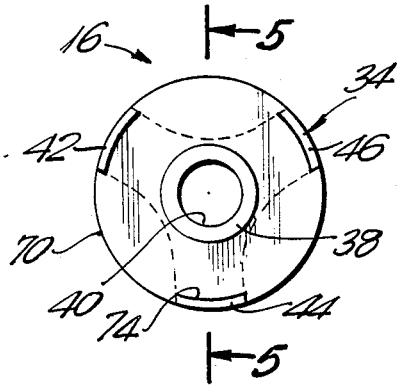
FIG. 4 is an end elevational view of the support bead as viewed from the right end o! FIG. 3.

A high frequency coaxial connector plug incorporating the dielectric support bead of the subject invention is illustrated in FIG. 1, and is identified generally by the numeral 10. A compatible coaxial socket which also incorporates the dielectric support bead of the subject invention is illustrated in FIG. 2, and is identified generally by the numeral 12. The coaxial connectors 10 and 12 are subminiature coaxial connectors generally known in the trade as SMA connectors. In particular, and with reference to FIG. 1, the coaxial connector plug 10 is provided with a center conductor 14 defining a pin terminal having a diameter "a" of 0.036–0.037 inch. The center conductor 14 is aligned along and defines the central axis of the coaxial connector plug 10.

The center conductor 14 is pressfit within the dielectric support bead 16 of the subject invention. A key function of the dielectric support bead 16 is to maintain the diametrically small center conductor 14 of the coaxial connector 10 in its concentric disposition with respect to the remainder of the plug connector 10. The specific construction of the dielectric support bead 16 is described in much greater detail below. The dielectric support bead 16 is pressfit into an electrically conductive body 18 which defines the outer conductor of the coaxial connector plug 10. The coaxial connector plug 10 further comprises a coupling nut 20 having an array of internal threads 22.

The coaxial plug connector 10 shown in FIG. 1 is mateable with the coaxial connector socket 12 shown in FIG. 2. More particularly, the coaxial connector socket 12 comprises an axially disposed pin receiving terminal 24 which defines the center conductor, and is constructed to electrically and mechanically engage the center conductor 14 of the coaxial plug connector 10 shown in FIG. 1. The center pin receiving conductor 24 of the coaxial socket connector 12 is pressfit into a dielectric support bead 26 which is structurally and functionally similar or identical to the dielectric support bead 16 in the coaxial connector plug 10. More particularly, the dielectric support bead 26 is constructed to maintain the center pin receiving conductor 24 in coaxial relationship to the remainder of the coaxial connector socket 12.

The dielectric support bead 26 is pressfit into in an electrically conductive bead holder 28 which in turn is pressfit into an electrically conductive body 30. The combination of the bead holder 28 and the body 30 define the outer conductor of the coaxial connector socket 12. The body 30 of the coaxial connector socket 12 is further defined by an array of external threads 32 which are engageable with the array of internal threads 22 on the coaxial connector plug 10 shown in FIG. 1.

The threaded interengagement of the coaxial connector plug 10 of FIG. 1 with the coaxial connector socket 12 of FIG. 2 achieves the electrical connection of the respective inner and outer conductive members. More particularly, the threaded interconnection of the coaxial connector plug 10 with the coaxial connector socket 12 will urge the center pin conductor 14 of the plug 10 into the center pin receiving conductor 24 of the socket 12, while the threaded interengagement achieves an electrical connection of the outer conductor members. It will be appreciated that FIGS. 1 and 2 are provided to show the dielectric support bead of the subject invention incorporated into typical high frequency coaxial connectors. However, this specific construction of the connector may vary widely depending upon the intended end use of the connector. For example, the dielectric support bead described and shown further below may be incorporated into right angle connectors or connectors having different radial or axial dimensions.

The dielectric support bead 16 shown generally in FIG. 1 is depicted in greater detail in FIGS. 3–6. More particularly, the dielectric support bead 16 includes a mating end indicated generally by the numeral 34 and shown more clearly in FIG. 4, and a mounting end indicated generally by the numeral 36 and shown more clearly in FIG. 6. The dielectric support bead 16 is disposed in an electrical connector such that the mating end 34 thereof is generally adjacent the mating end of a coaxial connector, and such that the mounting end 36 thereof is further within the coaxial connector.

The dielectric support bead 16 comprises a center support portion 38 having a central through aperture 40 extending axially therethrough. More particularly, the central through aperture is symmetrical about the center line of the dielectric support bead 16 and defines a diameter "b" of approximately 0.0354±0.0005 inch. The dimension "b" is selected such that the center conductor of the coaxial connector can be pressfit into the central through aperture 40 of the dielectric support bead 16.

Figure 5:
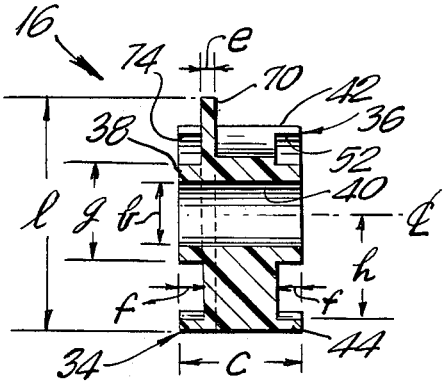
FIG. 5 is a cross-sectional view of the dielectric support bead taken along line 5—5 of FIG. 4.
Figure 6:
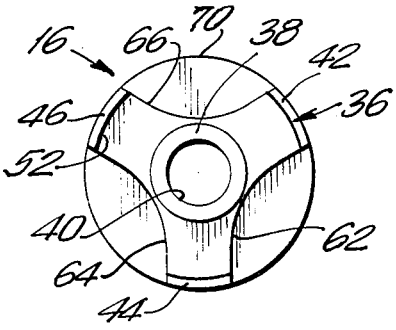
FIG. 6 is an end elevational view of the dielectric support bead as viewed from the left end of FIG. 3.

The dielectric support bead 16 further comprises outer support surfaces 42, 44 and 46 which are maintained in radially spaced concentric disposition around the central support 38 by support legs 52, 54 and 56 respectively. As shown most clearly in FIGS. 4 and 6, the outer support surfaces 42–46 define arcuate segments of a common cylinder which is concentrically disposed with respect to the central through aperture 40 and the center support portion 38. As shown in FIG. 5, the outer supports 42–46 define an axial length "c" substantially equal to the axial length of the center support portion 38. On the standard SMA connector, the axial length of the inner support portion 38 and outer support surfaces 42, 44 and 46 respectively will be 0.0600±0.005 inch.

The support legs 52–56 are uniquely constructed to achieve a low dielectric constant, to provide adequate support and concentricity between the center support portion 38 and the outer support surfaces 42–46, and to avoid any dimensional or geometric discontinuities that could affect the signal carrying characteristics over some range of frequencies or temperatures. More particularly, the support legs 52–56 taper into wider circumferential dimensions at radial distances closer to the center support portion 38. Additionally, adjacent support legs 52–54, 54–56 and 56–52 define concave surfaces 62, 64 and 66 respectively extending therebetween, as shown most clearly in FIGS. 3 and 6. In particular, the surfaces 62–66 each define concave substantially cylindrical surfaces having central axes which are parallel to and spaced uniformly about the center line of the dielectric support bead 16. As shown most clearly in FIGS. 4 and 6, the support legs 52–56 and the concave surfaces 62–66 are merged unitarily into the outer support surfaces 42–46 of the dielectric support bead 16, with no dimensional or geometric discontinuities adjacent the interfaces.

The dielectric support bead 16 further comprises an annular shroud 70 generally adjacent the mating end 34 of the support bead 16. The shroud 70 defines a diameter substantially equal to the diameter defined by the outer support surfaces 42–46. Additionally, the annular shroud 70 is coaxially formed with respect to the outer support surfaces 42–46. As a result the annular shroud 70 extends unitarily into the outer support surfaces 42–46, which, as noted above, define segments of a cylinder. As a result of this construction, the annular shroud 70 will contribute to the external support of the dielectric bead 16. However, the primary function of the shroud 70 is to prevent contaminants, such as gold flakes delaminated from the contact surfaces of the center conductor from migrating into internal portions of the connector, and thereby adversely affecting the signal carrying capabilities of the connector. In view of the minimum structural supporting function of the shroud 70, the axial dimension of the shroud 70, as indicated by dimension "e" can be substantially minimized. For example, the shroud 70 preferably has an axial length of 0.005 inch±0.001 inch. More particularly, the axial length of the shroud 70 may be equal to or less than one tenth the overall axial length of the dielectric support bead 16, enabling a low dielectric constant to be achieved.

The dielectric support bead 16 is further provided with annular undercuts 74 and 76 adjacent the opposed mating and mounting ends 34 and 36 respectively. In particular, the undercuts 74 and 76 define compensation steps which result in an impedance change to compensate for the stepped configuration of the body of the connector with which the dielectric support bead 16 is employed. The annular undercuts 74 and 76 are disposed to be concentric with the central axis of the dielectric support bead 16. Additionally, the annular undercuts 74 and 76 on dielectric support bead 16 for standard SMA connectors will define axial depths "i" of approximately 0.009±0.001 inch. The undercut is such that the outer diameter "g" of the center support portion 38 is approximately 0.050±0.002 inch, and such that the internal radius defined by the outer support 42–46, as indicated by dimension "h" in FIG. 5 is approximately equal to 0.054±0.0005 inch.

The connector described and illustrated above has been subjected to extensive temperature cycling tests and has performed substantially better than known prior art support beads. In particular, a dielectric support bead as described and illustrated above was mounted in a coaxial connector and tested over a range of frequencies from 1 to 41 GHz. The connectors with the subject support beads therein were tested for VSWR and detailed readings across the frequency range were recorded. The connectors were then thermally cycled for a total of five cycles. Each cycle involved lowering the temperature of the environment in which the connector was employed to −65° C. for a period of 30 minutes, and then elevating the temperature of the environment to 165° for another 30 minutes. After five such cycles, the connector was retested for the VSWR. Three separate connectors with the above described dielectric support bead were subjected to these tests, and on all three no evidence of any electrical degradation was found. Other available dielectric support beads in generally identical connectors were found to have upper temperature limits which range from 85° C.–105° C. before significant signal degradation was found.

The connectors described and illustrated above were further tested in the above described cycles with the higher elevation temperatures equal to 200° C. However, some slight changes in return and transmission loss were noticed after these elevated temperature cycling experiments. The absolute limit of the above described connector is believed to be at an upper temperature intermediate 165° C. and 200° C.

In summary, a dielectric support bead is provided for an electrical connector. The dielectric support bead comprises an inner support portion having a central through aperture dimensioned to be pressfit over the center conductor of the coaxial connector. The dielectric support bead further comprises a plurality of spaced apart outer support surfaces maintained in spaced radial disposition to the inner support portion by a plurality of support legs. The radial position of the outer support surfaces are selected to enable the dielectric support bead to be pressfit within the outer conductor of the coaxial connector. The outer support surfaces are generally elongated arcuate members defining segments of a cylinder and are concentrically disposed about the inner support portion of the bead. Adjacent support legs disposed about the periphery of the coaxial connector extend continuously from one to the next without any significant dimensional or geometric discontinuities. More particularly, continuous concave generally cylindrical surfaces extend between adjacent support legs of the dielectric support bead. These concave generally cylindrical surfaces are generated about axes that extend parallel to and are symmetrically disposed about the central axis of the dielectric support bead. A shroud defining a radius substantially equal to the diameter of the outer supports is disposed generally adjacent one end of the dielectric support bead. The shroud prevents contamination from entering the body of the connector. Such contamination could affect the quality of the signal transmitted by the connector. Opposed axial ends of the dielectric support bead are provided with annular undercuts to define compensation steps. The construction of the dielectric support bead has been found to yield superior performance over broad ranges of temperature variation with no signal degradation.

While the invention has been described with respect to a preferred embodiment, it is understood that variations can be made without departing from the scope of the invention as defined by the appended claims.

We claim:

1. A dielectric support bead for maintaining a center conductor of a coaxial connector in spaced coaxial relationship to an outer conductor thereof, said support bead comprising a center support portion having a central through aperture extending axially therethrough, said central through aperture being dimensioned for pressfit engagement with the center conductor of the coaxial connector, a plurality of spaced apart outer support surfaces defining segments of a cylinder, said outer support surfaces having an external diameter for engagement with the outer conductor of the coaxial connector, said outer support surfaces being maintained in spaced relationship to said inner support portion by support legs extending generally radially therebetween, a substantially annular shroud disposed around said inner support portion and defining an outer circumference having a radius substantially equal to the radius defined by said outer support surfaces, said shroud being operative to prevent contaminants from entering the coaxial connector at locations intermediate said support legs.

2. A dielectric support bead as in claim 1, wherein said dielectric support bead comprises opposed longitudinal ends, said shroud being disposed in proximity to one said longitudinal end of said dielectric support bead.

3. A dielectric support bead as in claim 1 wherein portions of said support bead intermediate adjacent support legs thereof are defined by generally continuous arcuate concave surfaces.

4. A dielectric support bead as in claim 3 wherein said concave arcuate surfaces define generally cylindrical surfaces having respective axes aligned substantially parallel to the axis of said central through aperture in said support bead.

5. A dielectric support bead as in claim 4 wherein the axes of the concave generally cylindrical surfaces between adjacent support legs are disposed at equal distances from the longitudinal axis of said support bead.

6. A dielectric support bead as in claim 5 wherein the distance between the longitudinal axis of said dielectric support bead and the axes of said concave generally cylindrical surfaces exceeds the radius defined by the outer support surfaces.

7. A dielectric support bead as in claim 1 further comprising generally annular undercuts adjacent the opposed longitudinal ends of said dielectric support bead.

8. A dielectric support bead as in claim 1, wherein said bead is unitarily molded from a plastic material.

9. A dielectric support bead as in claim 8 wherein the plastic material is ULTEM.

10. A high frequency coaxial connector for use in high temperature environments, said connector having a mating end for connection to a mating connector, and having an opposed end, said connector comprising:

a center conductor one end of which is free and generally disposed at the mating end of said connector for engagement with said mating connector;

an outer conductor spaced from said center conductor and disposed centrally thereabout; and an injection molded dielectric support bead formed from a plastic material, said support bead comprising a center support portion having a central through aperture extending axially therethrough, said central through aperture being pressfit over the center conductor of the coaxial connector, a plurality of spaced apart outer support surfaces defining segments of a cylinder, said outer support surfaces being radially disposed relative to the center support portion to be in engagement with the outer conductor of the coaxial connector, said outer support surfaces being maintained in spaced relationship to said inner support portion by respective support legs extending generally radially between the inner support portion and the associated outer support surface, a substantially annular shroud disposed around said inner support portion and defining an outer circumference having a radius substantially equal to the radius defined by said outer support surfaces, said shroud being operative to prevent contaminants from entering the coaxial connector at locations intermediate said support legs.

11. A coaxial connector as in claim 10 wherein said dielectric support bead comprises opposed longitudinal ends, said shroud being disposed in proximity to one said longitudinal end of said dielectric support bead.

12. A coaxial connector as in claim 10 wherein portions of said support bead intermediate adjacent support legs thereof are defined by generally continuous arcuate concave surfaces.

13. A coaxial connector as in claim 12 wherein said concave arcuate surfaces define generally cylindrical surfaces having respective axes aligned substantially parallel to the axis of the central through aperture in said support bead.

14. A coaxial connector as in claim 13 wherein the axes of the concave generally cylindrical surfaces between adjacent support legs are disposed at substantially equal distances from the longitudinal axis of said support bead.

15. A coaxial connector as in claim 14 wherein the distance between the longitudinal axis of said dielectric support bead and the axes of said concave generally cylindrical surfaces exceeds the radius defined by the outer support surfaces of the dielectric support bead.

16. A coaxial connector as in claim 10 wherein the dielectric support bead further comprises generally annular undercuts adjacent the opposed longitudinal ends thereof.

17. A coaxial connector as in claim 10 wherein the dielectric support bead is molded from ULTEM plastic.

* * * * *